US009093239B2

(12) United States Patent
Kato

(10) Patent No.: US 9,093,239 B2
(45) Date of Patent: Jul. 28, 2015

(54) ELECTROMAGNETIC RELAY

(75) Inventor: Yoshimasa Kato, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 13/882,900

(22) PCT Filed: Oct. 14, 2011

(86) PCT No.: PCT/JP2011/073650

§ 371 (c)(1),
(2), (4) Date: May 1, 2013

(87) PCT Pub. No.: WO2012/063600

PCT Pub. Date: May 18, 2012

(65) Prior Publication Data

US 2013/0222084 A1 Aug. 29, 2013

(30) Foreign Application Priority Data

Nov. 8, 2010 (JP) ..... 2010-249965

(51) Int. Cl.
*H01H 3/00* (2006.01)
*H01H 50/54* (2006.01)
(Continued)

(52) U.S. Cl.
CPC ..... *H01H 50/54* (2013.01); *H01H 50/043* (2013.01); *H01H 50/023* (2013.01); *H01H 51/22* (2013.01); *H01H 2050/028* (2013.01)

(58) Field of Classification Search
CPC ..... H01H 50/54; H01H 50/026; H01H 50/58; H01H 50/045; H01H 50/023; H01H 2050/028; H01H 51/22
USPC ..... 335/78–80, 128–131, 133–135, 335/185–189
See application file for complete search history.

(56) References Cited

U.S. PATENT DOCUMENTS 2,077,091 A 4/1937 Brander
5,357,230 A * 10/1994 Mikawa ..... 335/78
(Continued)

FOREIGN PATENT DOCUMENTS

EP 0093296 A1 11/1983
EP 0423834 A2 4/1991
(Continued)

OTHER PUBLICATIONS

International Search Report issued in International Patent Application No. PCT/JP2011/073650 mailed on Nov. 8, 2011.
(Continued)

*Primary Examiner* — Bernard Rojas
(74) *Attorney, Agent, or Firm* — McDermott Will & Emery LLP

(57) ABSTRACT

An electromagnetic relay (1) is formed by assembling a drive part (30), mobile body (50) that moves when the drive part (30) is driven, and a plurality of contact mechanisms (60, 70) that switch the contact and separation of contacts (61*d*, 62*d*, 71*d*, 72*d*) by the movement of the mobile body (50) in a body (40). Furthermore, the plurality of contact mechanisms (60, 70) has respective movable contact parts (61, 71) and fixed contact parts (62, 72). The electromagnetic relay (1) has at least one contact mechanism (60) provided with contacts (61*d*, 62*d*) connected respectively to the movable contact part (61) and fixed contact part (62) and also has at least one contact mechanism (70) in which either or both of the movable contact part (71) and fixed contact part (72) is provided with a plurality of contacts (71*d*, 72*d*).

2 Claims, 9 Drawing Sheets

(51) Int. Cl.

| | |
|---|---|
| ***H01H 50/04*** | (2006.01) |
| *H01H 50/02* | (2006.01) |
| *H01H 51/22* | (2006.01) |

(56) References Cited

U.S. PATENT DOCUMENTS

| | | | | |
|---|---|---|---|---|
| 5,907,268 | A * | 5/1999 | Mader | 335/202 |
| 6,046,661 | A * | 4/2000 | Reger et al. | 335/185 |
| 6,661,320 | B1 * | 12/2003 | Fausch | 335/129 |
| 6,906,604 | B1 * | 6/2005 | Mader et al. | 335/129 |
| 7,504,915 | B2 | 3/2009 | Takayama et al. | |
| 7,659,800 | B2 * | 2/2010 | Gruner et al. | 335/78 |
| 2001/0045878 | A1 * | 11/2001 | Fausch | 335/129 |
| 2011/0241809 | A1 * | 10/2011 | Sugisawa et al. | 335/188 |

FOREIGN PATENT DOCUMENTS

| | | |
|---|---|---|
| JP | 54-144238 | 3/1978 |
| JP | 56-037219 | 8/1979 |
| JP | 01-166947 | 5/1988 |
| JP | 2006-344397 A | 12/2006 |

OTHER PUBLICATIONS

Taiwanese Search Report issued Taiwanese Application No. 100139764 mailed Nov. 13, 2013, with English translation, 2 pgs.

European Search Report dated Sep. 18, 2014 issued in European Patent Application No. 11839180.4.

* cited by examiner

ELECTROMAGNETIC RELAY

RELATED APPLICATIONS

This application is the U.S. National Phase under 35 U.S.C. §371 of International Application No. PCT/JP2011/073650, filed on Oct. 14, 2011, which in turn claims the benefit of Japanese Application No. 2010-249965, filed on Nov. 8, 2010, the disclosures of which Applications are incorporated by reference herein.

TECHNICAL FIELD

The present invention relates to an electromagnetic relay.

BACKGROUND ART

One of conventionally known magnetic relays includes plural contact mechanisms arranged side by side on a base, each contact mechanism including contacts which are capable of coming into and out of contact with each other (for example, refer to Patent Literature 1).

In Patent Literature 1, each contact mechanism includes a movable contact piece and a fixed contact piece. Each of the movable and fixed contact pieces is provided with one contact.

In another known electromagnetic relay, each of the movable and fixed contact pieces in a contact mechanism is provided with plural contacts.

CITATION LIST

Patent Literature

Patent Document 1: Japanese Unexamined Patent Application Publication No. 2006-344397

SUMMARY OF INVENTION

However, in an electromagnetic relay in which each of the movable and fixed contact pieces of each contact mechanism is provided with one contact like the electromagnetic relay of Patent Literature 1, the contact reliability of contacts is low, and the intervention of foreign objects and the like could cause contact failure.

On the other hand, when each of the movable and fixed contact pieces of each contact mechanism is provided with plural contacts, the contact reliability of the contacts can be prevented from lowering. However, it is difficult to adjust the contact capacity, thus complicating the manufacturing process and increasing the cost.

An object of the present invention is to provide an electromagnetic relay with more contact reliability of contacts and manufactured at less cost.

Means for Solving the Problems

A first aspect of the present invention is an electromagnetic relay including: a drive part; a mobile body moved by driving the drive part; and a plurality of contact mechanisms in which contact and separation of contacts are switched by the movement of the mobile body, the drive part, mobile body, and contact mechanisms being assembled into a body, in which each of the plurality of contact mechanisms includes a movable contact part and a fixed contact part, and the plurality of contact mechanisms include at least one contact mechanism in which each of the movable and fixed contact parts is provided with one contact and at least one contact mechanism in which at least one of the movable and fixed contact parts is provided with plural contacts.

A second aspect of the present invention is that the contact mechanism provided with the plural contacts is a normally-closed contact.

A third aspect of the present invention is that the contact mechanism provided with the plural contacts is assembled into the position adjacent to the drive part.

A fourth aspect of the present invention is that the contact mechanism provided with the plural contacts is a contact mechanism in which one of the movable and fixed contact parts is provided with one contact while the other contact part is provided with plural contacts.

A fifth aspect of the present invention is that the fixed contact part is provided with one contact and the movable contact part is provided with plural contacts.

Effect of Invention

According to the present invention, the plurality of contact mechanisms include at least a contact mechanism in which each of the movable and fixed contact parts is provided with one contact and include at least a contact mechanism in which at least one of the movable and fixed contact parts is provided with a plurality of contacts. When the electromagnetic relay includes at least one contact mechanism in which at least one of the movable and fixed contact parts is provided with a plurality of contacts as described above, the contact reliability of the contacts can be increased. Moreover, when the electromagnetic relay includes at least one contact mechanism in which each of the movable and fixed contact parts is provided with one contact, an increase in cost can be prevented.

DESCRIPTION OF EMBODIMENTS

Figure 1:
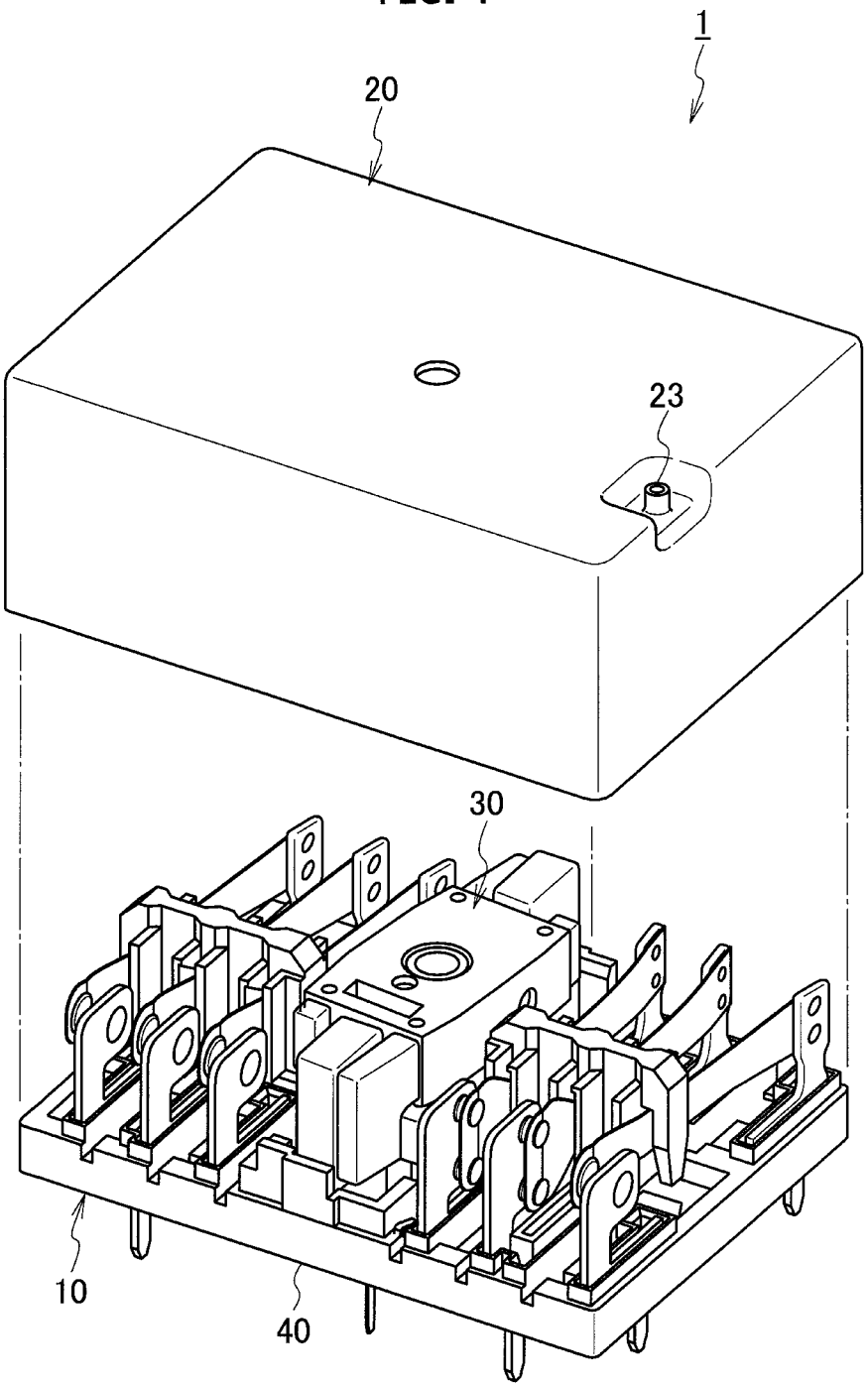
FIG. 1 is a partially-exploded perspective view showing an electromagnetic relay according to a first embodiment of the present invention.
Figure 2:
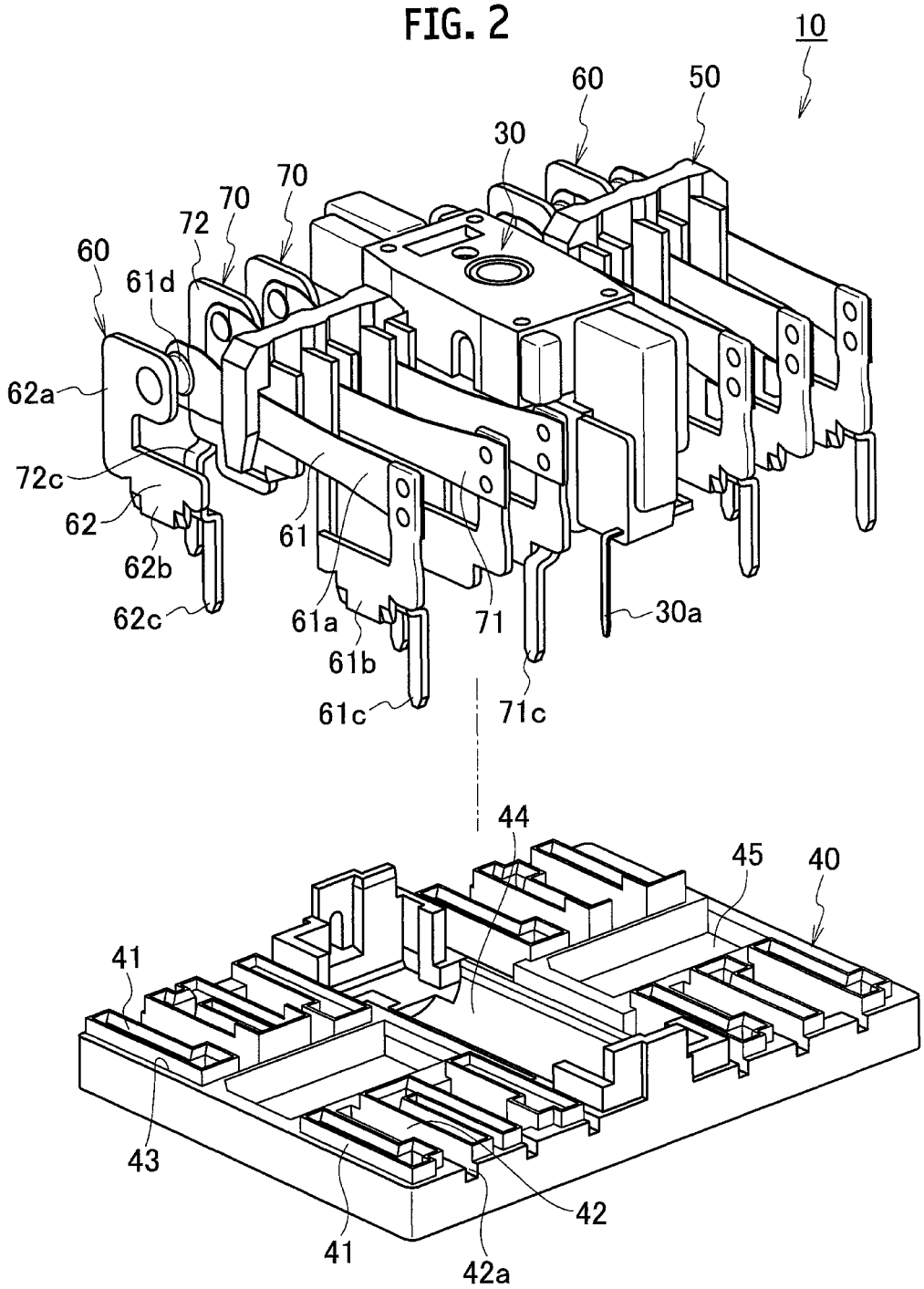
FIG. 2 is a partially-exploded perspective view showing a main part of the electromagnetic relay according to the first embodiment of the present invention.

Hereinafter, a detailed description is given of embodiments of the present invention with reference to the drawings. The following plural embodiments include the same constituent elements. Hereinafter, the same constituent elements are given the same reference numerals, and redundant description thereof is omitted.

First Embodiment

An electromagnetic relay 1 according to a first embodiment is formed into a substantially box-like shape by putting a case 20 over an electromagnetic relay main part 10 and bonding and fixing the case 20 to a body 40.

The electromagnetic relay main part 10 is formed by assembling an electromagnet device (a drive part) 30 and plural contact mechanisms 60 and 70 into the body 40.

Specifically, the electromagnet device 30 is assembled into a central part of the body 40 in the longitudinal direction, and the plural contact mechanisms 60 and 70 (three each in the first embodiment) are assembled into both sides of the body 40 in the longitudinal direction (at the both ends of the electromagnet device 30). Later-described movable contact parts 61 and 71 of the contact mechanisms 60 and 70 are clamped by a card (a mobile body) 50, thus forming the electromagnetic relay main part 10.

The electromagnet device (drive part) 30 is then driven by switching on and off electric conduction, and the drive of the electromagnet device (drive part) 30 is transmitted to the card 50, so that each of the plural contact mechanisms 60 and 70 can be switched to an opened state or a closed state.

A publicly-known device can be used as this electromagnet device (drive part) 30. For example, the electromagnet device 30 can be composed of a permanent magnet, a yoke, an armature, a movable spring, and a coil. With the thus-configured electromagnet device 30, the coil is energized to move the armature, and with the movement of the armature, the card 50 can be moved in the longitudinal direction of the body 40.

The electromagnet device 30 includes substrate connecting terminals 30*a* for connection with a not-shown substrate. The substrate connecting terminals 30*a* are inserted into respective terminal insertion holes 44*a*, which are formed in a recess 44 of the body 40 for the electromagnet device (drive part) 30. The electromagnet device 30 is then pressed into the recess 44 so that the terminal 30*a* protrudes to the lower surface side of the body 40, and the electromagnet device 30 is thus assembled into the central part of the body 40 in the longitudinal direction.

In the both ends of the body 40 having a substantially rectangular shape in the longitudinal direction, plural slit openings 41 for fixing the contact mechanisms are formed and extended in the cross-direction. Between the slit openings 41 adjacent to each other in the longitudinal direction of the body 40, slits 42 (latch parts: groove portions) are individually formed. To the slits 42, ends of later-described partition walls 21 are inserted.

In the periphery of the body 40 is formed a peripheral groove 43 for attachment of the case 20. The peripheral groove 43 is fitted over and bonded to the peripheral part 20*a* of the case 20, so that the case 20 is fitted over the body 40.

On each side of the recess 44 for mounting the electromagnet device (drive part) 30 in the central part of the body 40 in the cross direction, a guide recess 45 extending in the longitudinal direction of the body 40 is formed, so that the end of the card 50 is guided and moved in the guide recess 45.

Moreover, each of the plural contact mechanisms 60 includes a movable contact part 61 and a fixed contact part 62, and each of the plural contact mechanisms 70 includes a movable contact part 71 and a fixed contact part 72.

The movable contact part 61 includes: a sheeted plate spring 61*a* clamped by the card 50; a fixed plate 61*b* attached to the proximal end of the plate spring 61*a*; a substrate connecting terminal 61*c* provided in the fixed plate 61*b*; and a movable contact 61*d* provided in the distal end of the plate spring 61*a*.

On the other hand, the fixed contact part 62 includes: an upper fixed plate 62*a*; a lower fixed plate 62*b*; a substrate connecting terminal 62*c* provided in the lower fixed plate 62*b*; and a fixed contact 62*d* which is provided in the upper fixed plate and is capable of coming into and out of contact with the movable contact 61*d*.

The movable contact part 71 includes: a sheeted plate spring 71*a* clamped by the card 50; a fixed plate 71*b* attached to the proximal end of the plate spring 71*a*; a substrate connecting terminal 71*c* provided in the fixed plate 71*b*; and a movable contact 71*d* provided at the distal end of the plate spring 71*a*.

On the other hand, the fixed contact part 72 includes: an upper fixed plate 72*a*; a lower fixed plate 72*b*; a substrate connecting terminal 72*c* provided in the lower fixed plate 72*b*; and a fixed contact 72*d* which is provided in the upper fixed plate 72*a* and is capable of coming into and out of contact with the movable contact 71*d*.

The terminals 61*c*, 62*c*, 71*c*, and 72*c* are inserted into the slit openings 41 so as to protrude on the lower surface side of the body 40, and the movable contact parts 61 and 71 and fixed contact parts 62 and 72 are pressed into the respective slit openings 41, so that the movable contact parts 61 and 71 and fixed contact parts 62 and 72 are assembled into the body 40.

Herein, in the first embodiment, the movable contact part 61 and the fixed contact part 62 of each contact mechanism 60 are provided with one contact 61*d* and one contact 62*d*, respectively.

Moreover, the movable contact part 71 and the fixed contact part 72 of each contact mechanism 70 are provided with two contacts 71*d* and two contacts 72*d*, respectively. In the first embodiment, the two contacts 71*d* and 71*d* of the movable contact part 71 are arranged vertically side by side, and the two contacts 72*d* and 72*d* of the fixed contact part 72 are arranged vertically side by side. The upper contacts 71*d* and 72*d* come into contact with each other, and the lower contacts 71*d* and 72*d* come into contact with each other.

As described above, the electromagnetic relay 1 according to the embodiment includes at least one contact mechanism 60 in which the movable and fixed contact parts and 62 are provided with the contacts 61*d* and 62*d*, respectively. The electromagnetic relay 1 further includes at least one contact mechanism 70 in which at least one of the movable and fixed contact parts 71 and 72*d* (both, in this embodiment) is provided with plural (two) contacts 71*d* or 72*d*.

Figure 3:
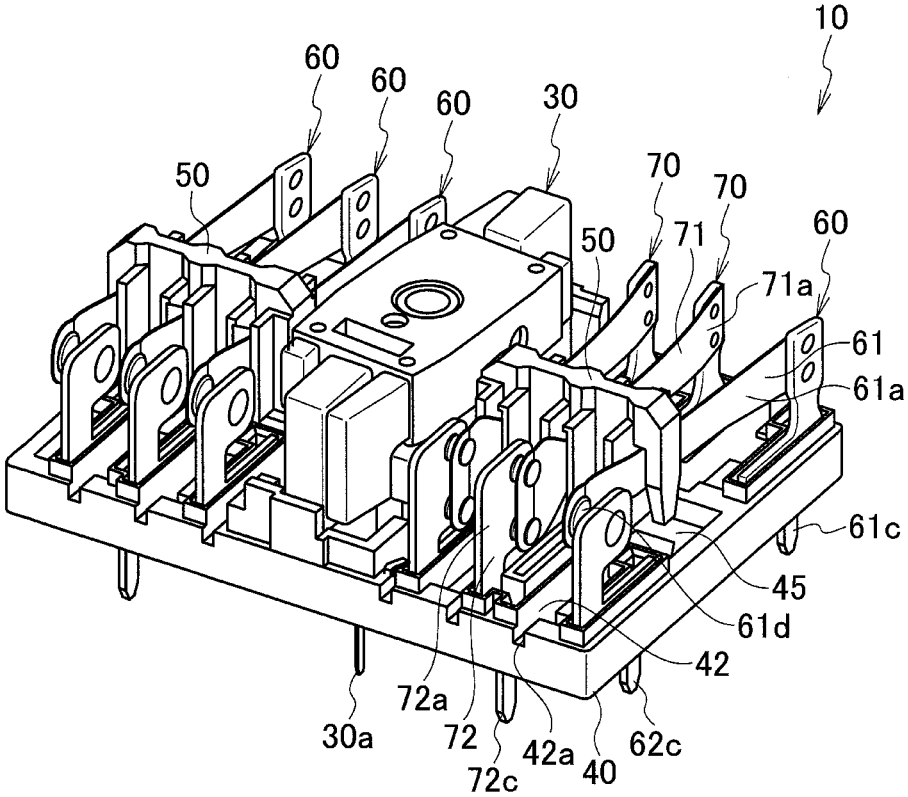
FIG. 3 is a perspective view showing the main part of the electromagnetic relay according to the first embodiment of the present invention.
Figure 6:
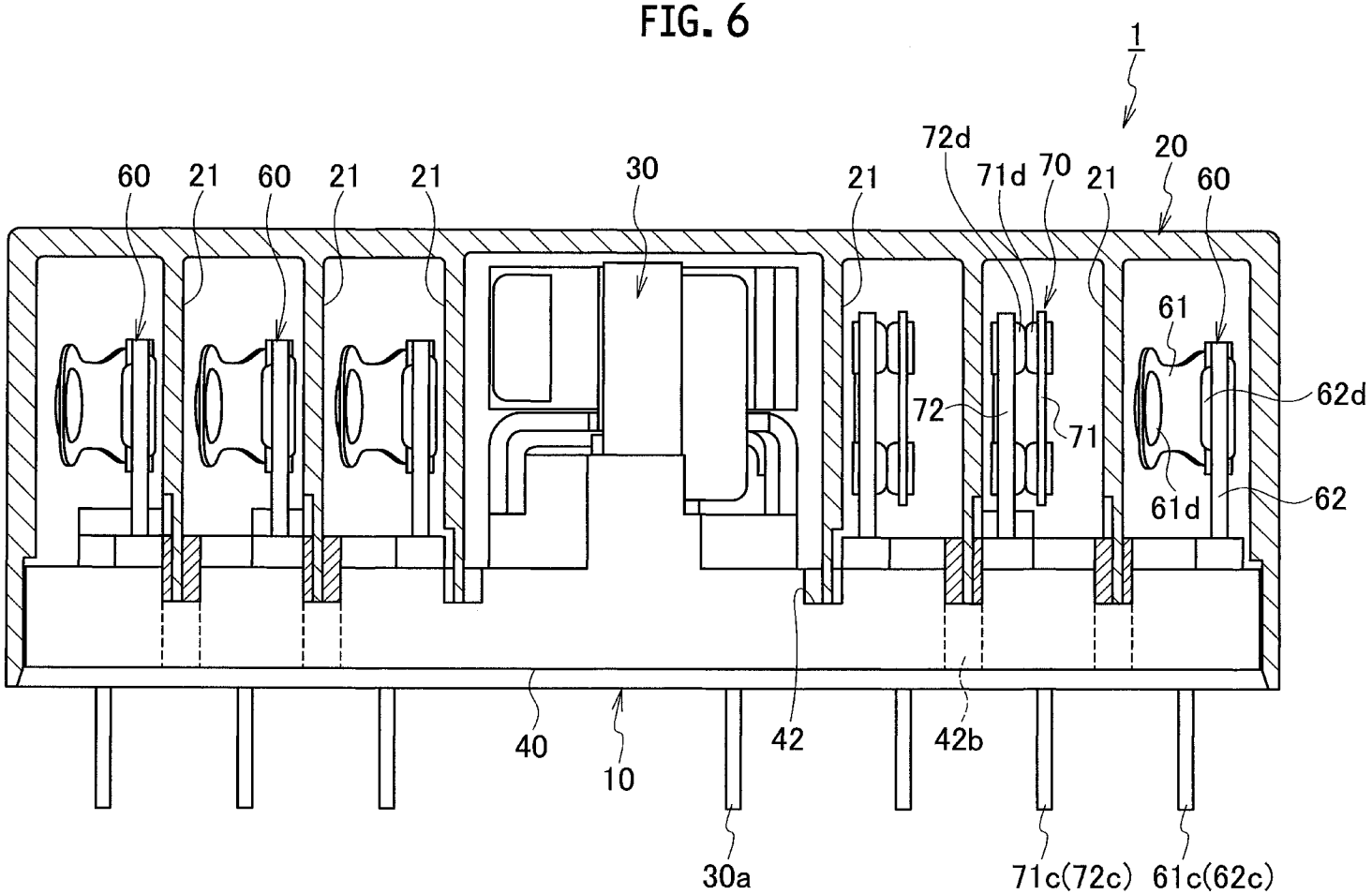
FIG. 6 is a longitudinal-sectional view schematically showing the electromagnetic relay according to the first embodiment of the present invention.

In this embodiment, as shown in FIGS. 3 and 6, the contact mechanisms (the contact mechanisms each including plural contacts) 70 are normally-closed contacts. Specifically, in each contact mechanism (contact mechanism including plural contacts) 70, the contacts 71*d* and 72*d* are in contact with each other while the electromagnet device (drive part) 30 is not excited, and the contacts 71*d* and 72*d* are separated from each other when the electromagnet device (drive part) 30 is excited.

On the other hand, the contact mechanisms (contact mechanisms each including one contact) 60 are normally-open contacts. To be specific, in each contact mechanism (contact mechanism each including one contact) 60, when the electromagnet device (drive part) 30 is not excited, the contacts 61*d* and 62*d* are separated from each other, and when the electromagnet device (drive part) 30 is excited, the contacts 61*d* and 62*d* come into contact with each other.

In this embodiment, as shown in FIG. 6, the contact mechanism 70 as a normally-closed contact, the contact mechanism 70 as a normally-closed contact, and the contact mechanism 60 as a normally-open contact are arranged in this order from the electromagnet device 30 to the right side. the three contact mechanisms 60 as normally-open contacts are arranged from the electromagnet device (drive part) 30 to the left side.

By making the electromagnetic relay 1 a multipole electromagnetic relay as described above, the one electromagnetic relay 1 can be adapted to various types of circuits and can be used as an electromagnetic relay meeting various requirements such as an electromagnetic relay for signal control and an electromagnetic relay for high-current control.

The case 20 has a substantially box-like shape open at the bottom and is configured to cover the electromagnet device (drive part) 30 and plural contact mechanisms 60 and 70 assembled into the body 40 from above. In the first embodiment, the case 20 is fit onto the body 40 by bonding the peripheral part 20*a* of the case 20 to the peripheral groove 43 with an adhesive. Reference numeral 23 of FIG. 1 denotes a hole to let out air in the process of bonding and curing the case 20 in order to prevent the internal pressure from becoming high.

Figure 4:
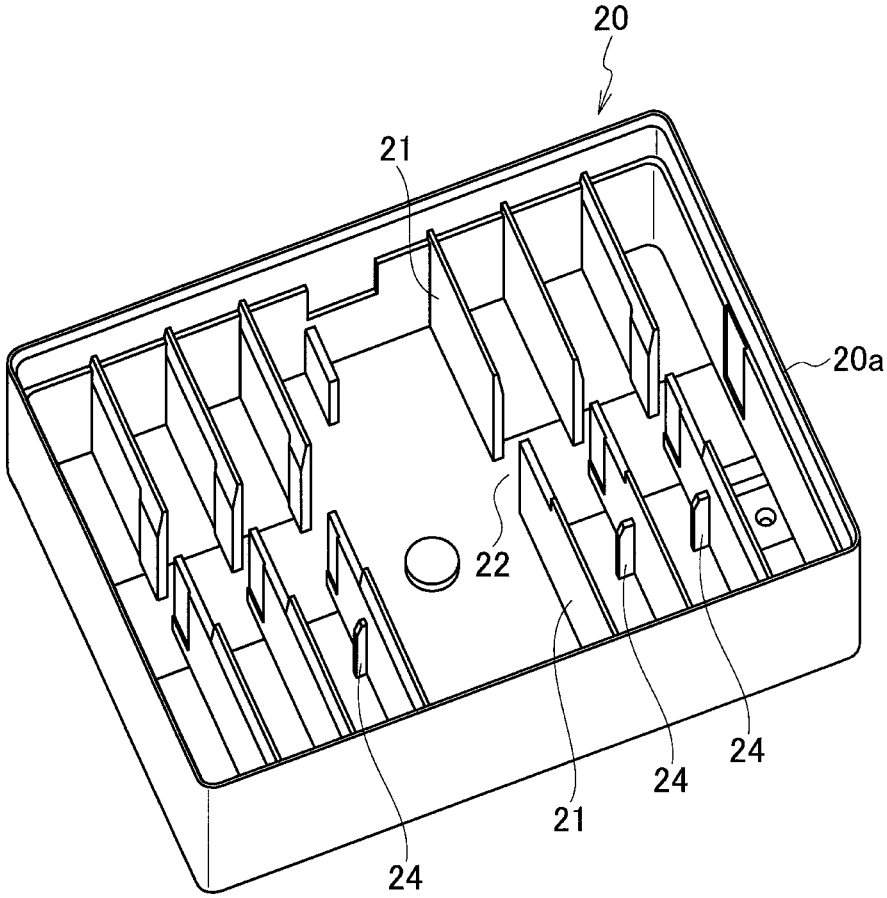
FIG. 4 is a perspective view showing the inside of the case of the electromagnetic relay according to the first embodiment of the present invention.

In the first embodiment, the partition walls 21 are provided within the case 20. Specifically, in the case 20, three (plural) partition walls 21 extending in the cross direction are arranged in the longitudinal direction side by side. In the central part of the partition walls 21 in the cross direction, space 22 allowing the card 50 to move therethrough is formed. In other words, six of the partition walls 21 are arranged side by side on one side in the cross direction, and the other six are arranged side by side on the other side in the cross direction. Reference numeral 24 of FIG. 4 denotes later-described wall portions which reinforce the partition walls 21 and limit the ranges of movement of the contact mechanisms 60 and 70.

Moreover, in the body 40, engagement parts are provided at respective portions corresponding to the partition walls 21. The ends of the partition walls 21 are engaged with the engagement parts when the case 20 is fit over the body 40.

In the first embodiment, each engagement portion includes a slit (groove) 42 into which the end of the corresponding partition wall 21 of the case 20 is inserted; and an adhesive-introducing through hole 42*b* formed in the slit 42 so as to penetrate to the rear side of the body 40.

The ends of the partition walls 21 are engaged with the respective engagement portions with an adhesive. Specifically, in the process of fitting the case 20 onto the body 40, the ends of the partition walls 21 of the case 20 are inserted into the respective slits 42, and in this state, the adhesive is introduced to the slits 42 through the through holes 42*b* from the rear side of the body 40. The ends of the partition walls 21 are thus bonded and fixed to the respective engagement portions.

By bonding and fixing the ends of the partition walls 21 and the engagement portions in such a manner, in the process of solidification bonding (thermosetting) of the case 20 to the body 40, the case 20 and body 40 can be prevented from warping or deforming by expansion when the electromagnetic relay 1 is heated and by contraction when the electromagnetic relay 1 is cooled.

Furthermore, in the first embodiment, a regulating part configured to regulate the movement of the adhesive is formed between each slit (engagement portion) 42 and the corresponding partition wall 21.

Figure 7:
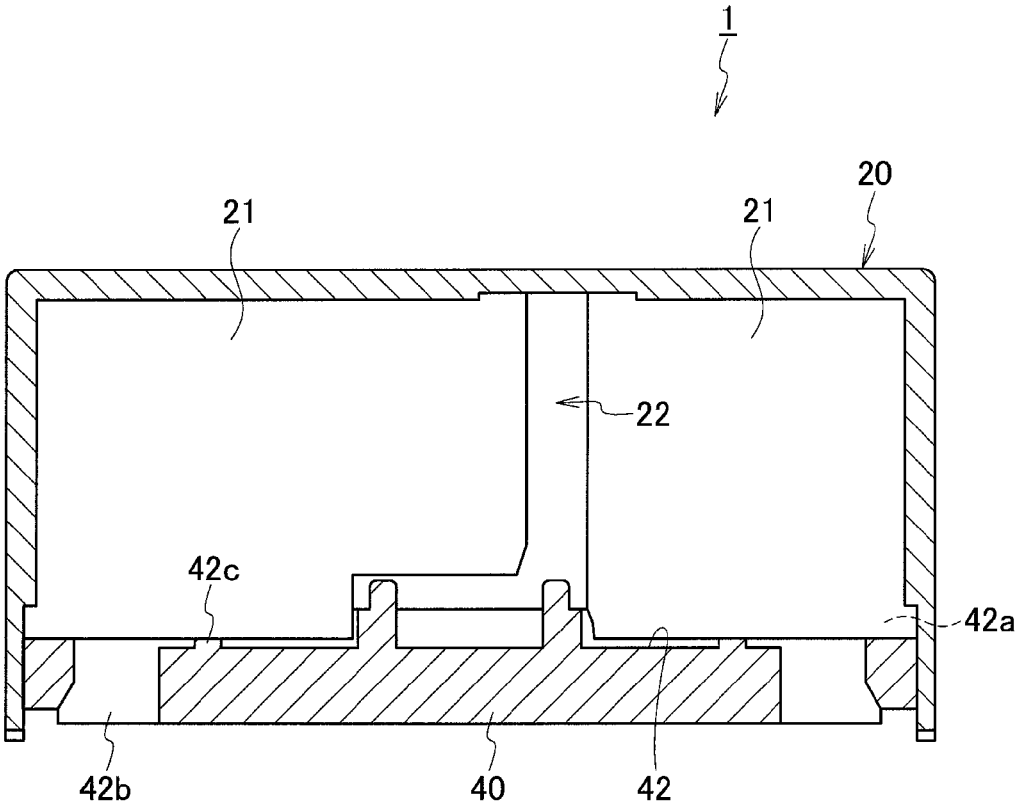
FIG. 7 is a cross-sectional view schematically showing the electromagnetic relay according to the first embodiment of the present invention.

Specifically, as shown in FIG. 7, a protrusion (a regulating part) 42*c* is provided closer to the center of the body 40 in the cross direction than the through hole 42*b* of the slit 42. This protrusion 42*c* prevents the adhesive from flowing into the inner side of the protrusion 42*c* in the cross direction. By preventing the adhesive from flowing into the center side of the body 40 in the cross direction, it is possible to prevent the adhesive from interfering with the movement of the card 50 and the like.

In the first embodiment, moreover, the plural contact mechanisms 60 and 70 are isolated from each other with the partition walls 21 in the state where the case 20 is fitted over the body 40.

In other words, the partition walls 21 are configured to individually separate the contact mechanisms 60 and 70 from each other when the body 40 is fixed to the case 20. By separating the contact mechanisms 60 and 70 from each other with the partition walls 21, the contact mechanisms 60 and 70 are insulated from each other. In the first embodiment, specifically, the partition walls 21 have a function as an insulating member for insulating the contact mechanisms 60 and 70 from each other. In this embodiment, each partition wall 21 is made thin at the end portion. This can enhance the insulation strength of the contact mechanisms 60 and 70 while facilitating insertion of the ends of the partition walls 21 into the respective slits 42.

Figure 5:
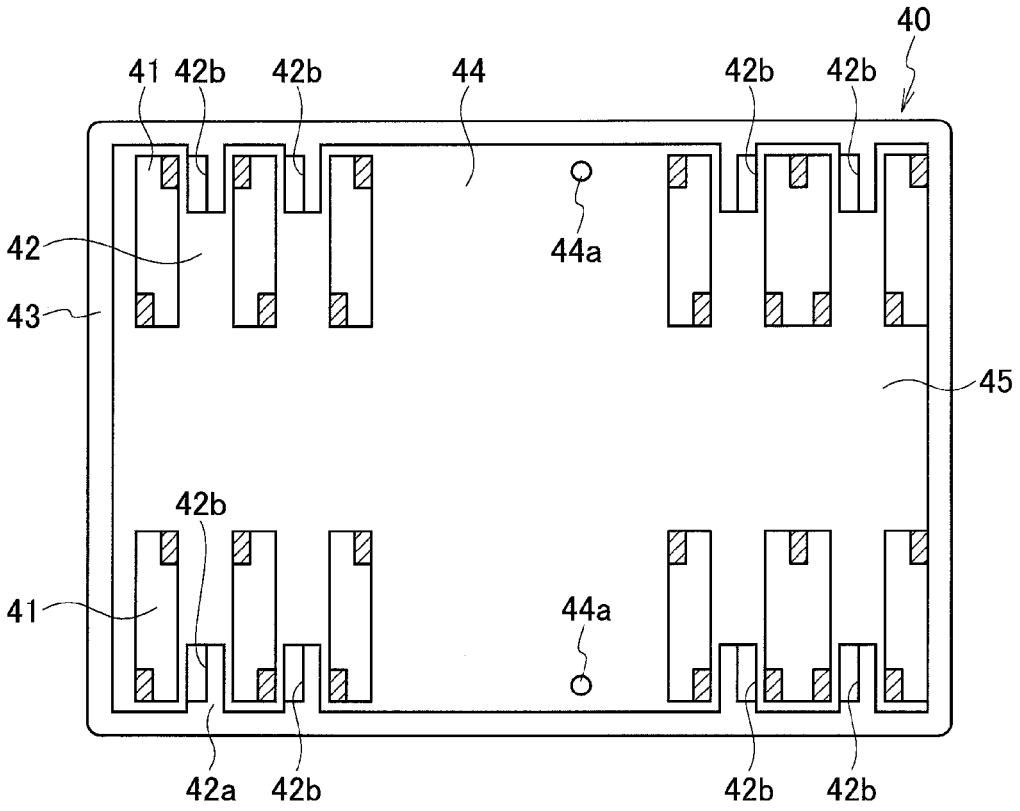
FIG. 5 is a plan view schematically showing a base of the electromagnetic relay according to the first embodiment of the present invention.

Furthermore, in the first embodiment, as shown in FIGS. 3 and 5, each of the slits 42 includes an opening part 42*a* opened in the side portion of the body 40. The opening parts 42*a* thus formed in the slits 42 allow the adhesive used for bonding the peripheral part 20*a* of the case 20 to the peripheral groove 43 to infiltrate into the slits 42. This can further enhance the durability (strength and heat resistance) of the relay 1.

As described above, in this embodiment, the plural contact mechanisms 60 and 70 include at least the one contact mechanism 60 having the movable and fixed contact parts 61 and 62 which are provided with the contacts 61*d* and 62*d*, respectively, and at least the one contact mechanism 70 having the movable and fixed contact parts 71 and 72 at least one of which is provided with plural contacts 71*d* or 72*d*. The provision of at least the one contact mechanism 70 having the movable and fixed contact parts 71 and 72 at least one of which is provided with the plural contacts 71*d* or 72*d* can increase the contact reliability of contacts of the electromagnetic relay 1. Moreover, the provision of at least the one contact mechanisms 60 having the movable and fixed contact parts 61 and 62 which are provided with the contacts 61*d* and 62*d*, respectively, can prevent the cost from increasing. According to the present invention, therefore, it is possible to obtain the electromagnetic relay 1 which can reduce the cost while increasing the contact reliability.

According to the first embodiment, the contact mechanisms 70 each including the plural contacts 71*d* or 72*d* are used as normally-closed contacts.

In the case of a normally-closed contact, once foreign objects are attached to the contact in the process of assembling the contact mechanism into the body 40, it is difficult to remove the same. Accordingly, the use of the contact mechanisms (the contact mechanism each including plural contacts) 70, which have higher contact reliability than the contact mechanisms (the contact mechanism each including one contact) 60, as the normally-closed contact can further increase the contact reliability.

Second Embodiment

An electromagnetic relay 1A according to a second embodiment basically has substantially the same configuration as that of the electromagnetic relay 1 of the first embodiment. The electromagnetic relay 1A is formed into a substantially box-like shape by putting the case 20 over the electromagnetic relay body portion 10 and bonding and fixing the case 20 to the body 40.

The major difference of the electromagnetic relay 1A of the second embodiment from the electromagnetic relay 1 of the first embodiment is that the contact mechanisms (contact mechanisms each including plural contacts) 70 are assembled into the body 40 at the position adjacent to the electromagnet device (drive part) 30.

Figure 8:
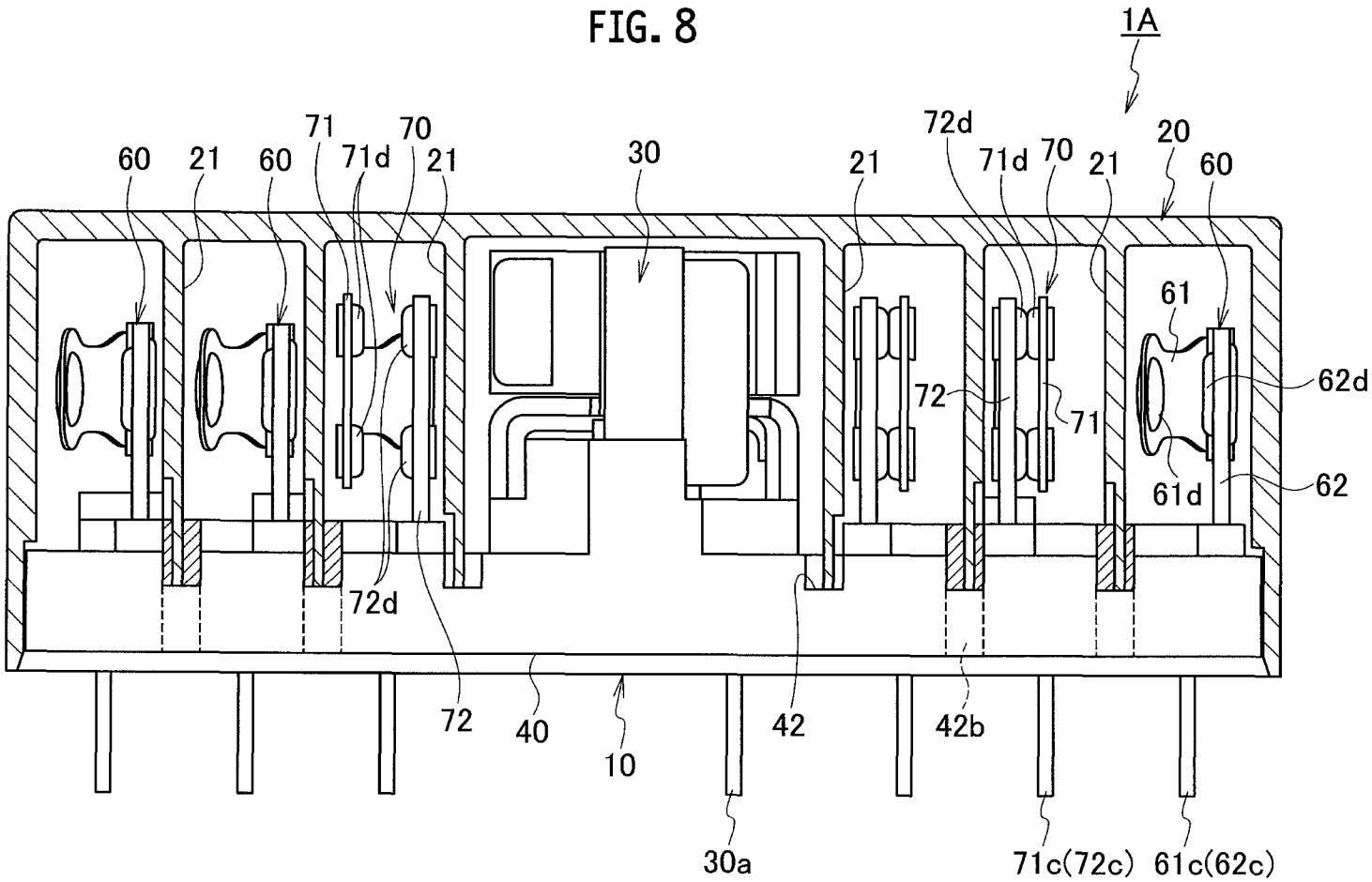
FIG. 8 is a longitudinal-sectional view schematically showing an electromagnetic relay according to a second embodiment of the present invention.

Specifically, as shown in FIG. 8, the contact mechanism 70 as a normally-closed contact, the contact mechanism 70 as a normally-closed contact, and the contact mechanism 60 as a normally-opened contact are arranged in this order from the electromagnet device 30 to the right side. That is, a contact mechanism 70 as a normally-opened contact, a contact mechanism 60 as a normally-opened contact, and a contact mechanism 60 as a normally-opened contact are arranged in this order from the electromagnet device 30 to the left side. In the example illustrated in the second embodiment, the contact mechanism 70 as the normally-opened contact is provided on the left side of the electromagnet device (drive part) 30. However, the contact mechanism 70 as the normally-closed contact may be located on the left side.

The second embodiment can also bring about similar operations and effects as those of the first embodiment.

Meanwhile, where the contact mechanisms of the electromagnetic relay 1 are repeatedly opened and closed to be worn out, the contact mechanism located closer to the drive part is more likely to be subjected to adherence of waste powder to the contacts.

Consequently, in the second embodiment, the contact mechanisms (contact mechanisms each including plural contacts) 70, which have higher contact reliability than the contact mechanisms (contact mechanisms each including one contact) 60, is located adjacent to the electromagnet device (drive part) 30, so that the contact reliability can be further increased.

Third Embodiment

An electromagnetic relay 1B according to a third embodiment basically has substantially the same configuration as the electromagnetic relay 1A of the aforementioned second embodiment. The electromagnetic relay 1B is formed in a substantially box-like shape by putting the case 20 over the electromagnetic relay main part 10 and bonding and fixing the case 20 to the body 40.

Herein, the major difference of the electromagnetic relay 1B of the this embodiment from the electromagnetic relay 1A of the second embodiment is that the contact mechanism including plural contacts is a contact mechanism 70B in which one of the movable and fixed contact parts is provided with one contact and the other contact part is provided with plural contacts.

Figure 9:
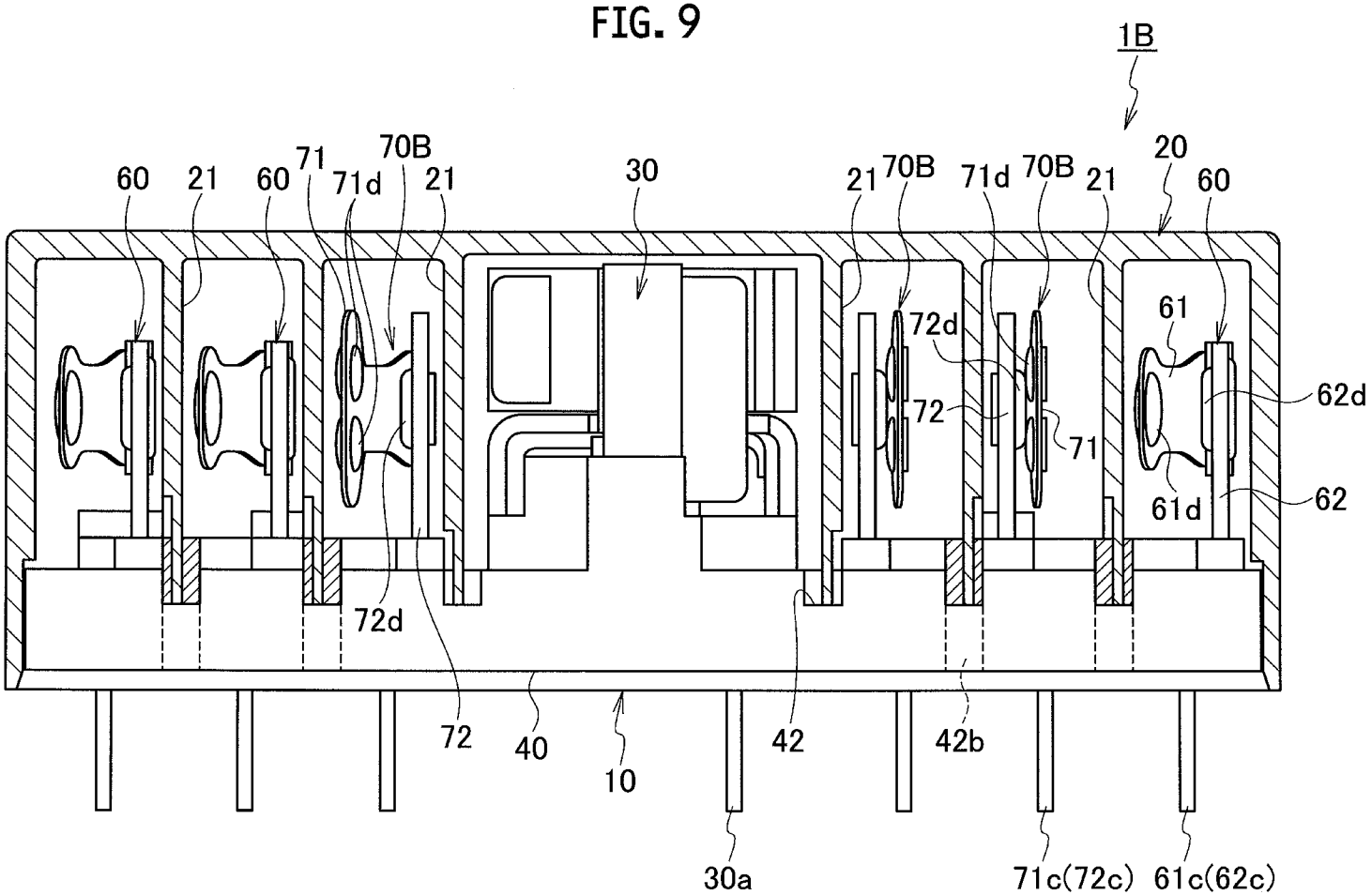
FIG. 9 is a longitudinal-sectional view schematically showing an electromagnetic relay according to a third embodiment of the present invention.

Specifically, as shown in FIG. 9, the contact mechanism 70B is arranged near each end of the electromagnet device 30. The movable contact part 71, which is more deformable than the fixed contact part 72, is provided with plural (two) contacts 71*d*, and the fixed contact part 72 is provided with one contact 72*d*, which is slightly larger than the contacts 71*d*. In the third embodiment, the two contacts 71*d* come into contact with the one contact 72*d* when the contact mechanism 70B is closed.

This embodiment can also bring about the same operations and effects as those of the aforementioned first embodiment.

Like this embodiment, when the contact mechanism provided with plural contacts is composed of the contact mechanism 70B, in which one of the movable and fixed contact parts is provided with one contact while the other contact part is provided with plural contacts, it is possible to reduce the steps of providing plural contacts, thus facilitating the manufacturing and reducing the cost.

In the third embodiment, in particular, the fixed contact part 72 is provided with the one contact 72*d* while the movable contact part 71 is provided with the two (plural) contacts 71*d*. Therefore, in the process of moving the movable contact part 71 to bring the contacts 71*d* and 72*d* into contact with each other, even if the position of the movable contact part 71 is shifted and only one of the contacts 71*d* comes into contact with the surface of the contact 72*d* (the side surface in FIG. 7), the other contact 71*d* can be moved (around) to the contact 72*d* side by pressing the movable contact part 71 with the card 50 or any other means and can be brought into contact with the circumferential surface of the contact 72*d*.

In other words, by providing the one contact 72*d* in the fixed contact part 72 while providing the two (plural) contacts 71*d* in the movable contact part 71, it is possible to prevent the contacts 71*d* from coming into partial contact with the contact 72*d* (prevent the contact 72*d* from coming into contact with only one of the two contacts 71*d*), thus increasing the contact reliability.

Hereinabove, the preferred embodiments of the present invention are described. However, the present invention is not limited to the above-described embodiments and can be variously modified.

For example, in each example illustrated in the above-described embodiments, the plural contact mechanisms are arranged on both sides of the drive part side by side. However, the plural contact mechanisms may be arranged side by side on one side of the drive part.

Moreover, the specifications (shapes, sizes, layouts, and the like) of the movable springs, contacts, and other details can be properly changed.

INDUSTRIAL APPLICABILITY

According to the present invention, it is possible to provide an electromagnetic relay with the contact reliability of contacts increased and the cost reduced.

The invention claimed is:

1. An electromagnetic relay, comprising:

a drive part;

a mobile body moved by driving the drive part; and a plurality of contact mechanisms in which contact and separation are switched by the movement of the mobile body, the drive part, mobile body, and contact mechanisms being assembled into a body, wherein each of the plurality of contact mechanisms includes a movable contact part and a fixed contact part, the plurality of contact mechanisms include at least one contact mechanism in which each of the movable and fixed contact parts is provided with one contact, and at least one contact mechanism in which each of the movable and fixed contact parts is provided with plural contacts, wherein a first wide part is provided at an end part of the movable contact part provided with the plural contacts and the plural contacts of the movable contact part are provided on the first wide part, and a second wide part is provided at an end part of the fixed contact part provided with the plural contacts and the plural contacts of the fixed contact part are provided on the second wide part, and in the contact mechanism provided with the plural contacts, the contact of the movable contact part and the contact of the fixed contact part are in contact with each other while the drive part is not driven, and the contact of the movable contact part and the contact of the fixed contact part are separated from each other when the drive part is driven.

2. The electromagnetic relay according to claim 1, wherein the contact mechanism provided with the plural contacts is assembled into the position adjacent to the drive part.

* * * * *